US010947016B2

(12) United States Patent
Van De Klippe

(10) Patent No.: US 10,947,016 B2
(45) Date of Patent: Mar. 16, 2021

(54) CLOSURE CAPS AND CLOSURES

(71) Applicant: GREIF INTERNATIONAL HOLDING BV, Amstelveen (NL)

(72) Inventor: Cornelis Van De Klippe, West Chicago, IL (US)

(73) Assignee: GREIF INTERNATIONAL HOLDING BV, Amstelveen (NL)

( * ) Notice: Subject to any disclaimer, the term of this patent is extended or adjusted under 35 U.S.C. 154(b) by 13 days.

(21) Appl. No.: 16/479,905

(22) PCT Filed: Feb. 9, 2018

(86) PCT No.: PCT/EP2018/053364
§ 371 (c)(1),
(2) Date: Jul. 22, 2019

(87) PCT Pub. No.: WO2018/149763
PCT Pub. Date: Aug. 23, 2018

(65) Prior Publication Data

US 2019/0389631 A1 Dec. 26, 2019

Related U.S. Application Data

(60) Provisional application No. 62/459,994, filed on Feb. 16, 2017.

(51) Int. Cl.
*B65D 41/58* (2006.01)
*B65D 39/08* (2006.01)
*B65D 55/08* (2006.01)

(52) U.S. Cl.
CPC ..... *B65D 41/58* (2013.01); *B65D 39/08* (2013.01); *B65D 55/0863* (2013.01)

(58) Field of Classification Search
CPC .... B65D 41/3428; B65D 41/58; B65D 41/60; B65D 51/18; B65D 43/021; B65D 39/10;
(Continued)

(56) References Cited

U.S. PATENT DOCUMENTS 4,667,842 A * 5/1987 Collins ..... B29C 66/1122 220/789
6,726,048 B2 4/2004 Dwinell et al.
(Continued)

FOREIGN PATENT DOCUMENTS

DE 20 2015 008143 U1 12/2015
EP 2 144 821 A1 1/2010
(Continued)

*Primary Examiner* — Robert J Hicks
(74) *Attorney, Agent, or Firm* — Mark E. Bandy; Rankin, Hill & Clark LLP

(57) ABSTRACT

A cap for a screw-threaded container closure or closure plug includes a cap top and an attachment ring. The attachment ring is securingly engageable with the container closure or closure plug. The attachment ring comprises a cam surface and an upwardly facing shoulder above the cam surface. The container closure or closure plug comprises a plurality of lugs engageable by a wrench or other drive tool. Each lug includes a radially inwardly facing guide surface comprising a downwardly and radially inwardly sloping portion and a downwardly facing shoulder extending radially outward below the downwardly and radially inwardly sloping portion. A secure and relatively easy engagement between the cap and container closure or closure plug is thereby obtainable.

19 Claims, 5 Drawing Sheets

(58) Field of Classification Search
CPC ..... B65D 39/08; B65D 39/0058; B65D 55/0863; B65D 55/08; B65D 55/06; B65D 55/024
USPC ..... 220/257.1, 257.2, 256.1, 212, 791, 789, 220/266, 265, 288; 215/364, 355, 253, 215/250; 81/3.41, 3.4
See application file for complete search history.

(56) References Cited

U.S. PATENT DOCUMENTS

| | | | | |
|---|---|---|---|---|
| 8,813,988 | B2 * | 8/2014 | Ledemeney | B65D 55/0863 220/257.2 |
| 2010/0301046 | A1 | 12/2010 | Schuetz | |

FOREIGN PATENT DOCUMENTS

| | | | |
|---|---|---|---|
| WO | 2005/056411 | A1 | 6/2005 |
| WO | 2008/139196 | A1 | 11/2008 |

* cited by examiner

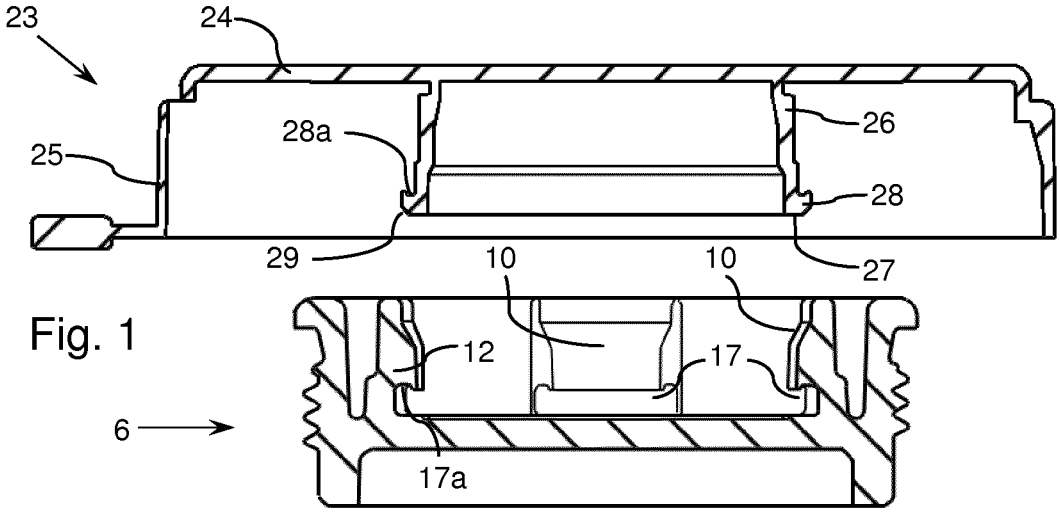
Fig. 1
Fig. 2
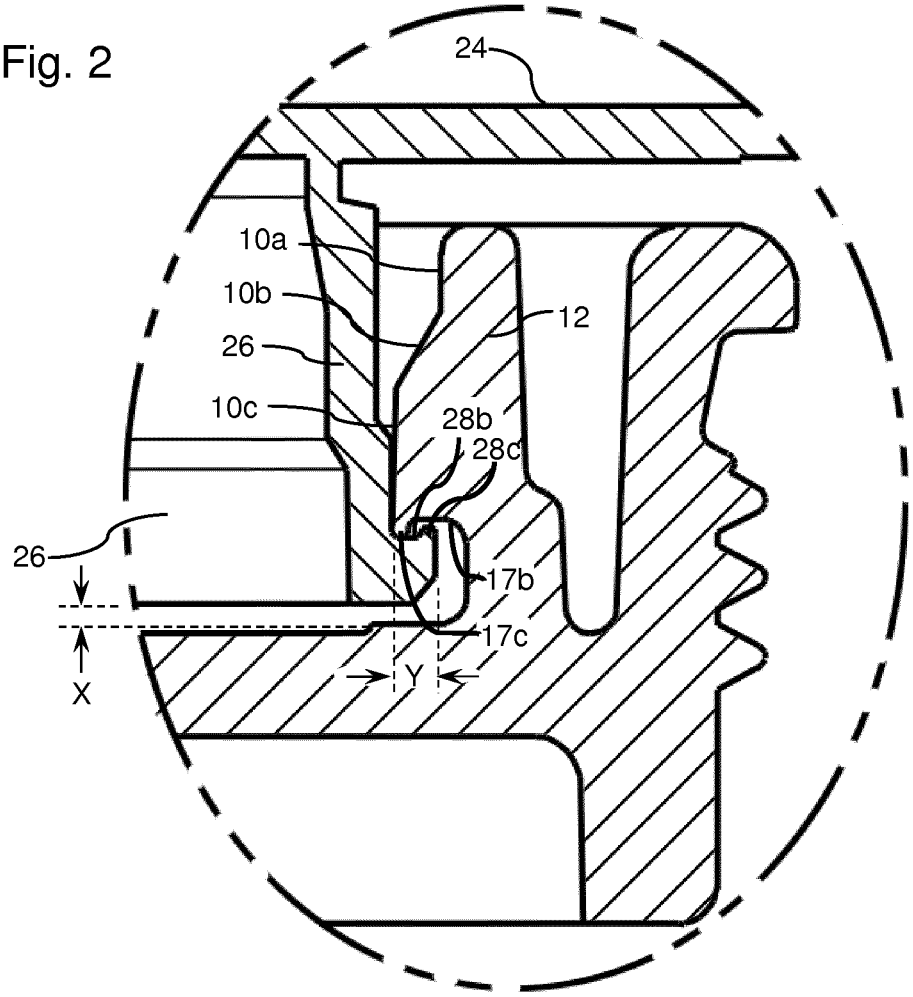

CLOSURE CAPS AND CLOSURES

CROSS-REFERENCE TO RELATED APPLICATIONS

This application is a National Stage of International patent application PCT/EP2018/053364, filed on Feb. 9, 2018, which claims priority to earlier filed, U.S. Provisional Application No. 62/459,994, filed on Feb. 16, 2017, the disclosures of which are incorporated by reference in their entirety.

This invention is directed to closure caps or overseals and is principally, but not exclusively, directed towards closure caps or overseals for plugs or other closures used in industrially sized bulk containers such as drums. The invention also pertains to such closures, as well as to combinations of such closures and closure caps or overseals.

EP2144821B1 discloses a cap for a container closure or closure plug, comprising a cap top and an attachment ring extending axially downward from beneath the bottom surface of the cap top under a central portion of the cap top, the attachment ring being securingly engageable with the container closure or closure plug. For this purpose the attachment ring comprises a cam surface extending radially outward from the attachment ring, the cam surface being configured to deflect the attachment ring radially inward upon engagement of the attachment ring with the container closure or closure plug. The container closure or closure plug is screw-threaded and provided with a series of (typically four) radially inwardly extending wrench-engaging lugs. These are engageable with a wrench or other suitable drive tool for tightening the closure or plug onto or into a corresponding screw thread provided about the container opening, and for unscrewing the closure or plug again, for accessing the container contents. Each lug provides a radially inwardly facing guide surface. Opposing upper ends the respective guide surfaces form an entrance portion into which the attachment ring is insertable, preferably as a sliding fit. Below the upper end, each guide surface transitions into a downwardly and radially inwardly sloping portion, so that as the attachment ring is pushed further downward between the lugs, the cam surface rides along the sloping portions so as to compress and radially inwardly deform the attachment ring in between the lugs. Below the downwardly and radially inwardly sloping portion, the guide surface of each lug transitions into a downwardly facing shoulder extending radially outward from the portion of the guide surface above, e.g. formed by an undercut groove in each lug, positioned at some distance from the upper end of the lug, e.g. towards the base of each lug, e.g. at or near to where the base of each lug joins a bottom wall of the container closure or closure plug. When the cam surface passes beyond the downwardly facing shoulders on the lugs, the radially inward pressure of the guide surfaces on the attachment ring ceases. At this point the attachment ring therefore resiliently expands radially outwards, such that an upwardly facing shoulder provided thereon above the cam surface, snaps beneath the downwardly facing shoulders of the guide surfaces. The attachment ring is thereby retained between the lugs as a snap-fit. To provide secure retention so that the attachment ring cannot easily be pulled upwards out of engagement between the lugs, the radial extent of the engagement between the upwardly facing shoulder on the attachment ring and the downwardly facing shoulders on the lug guide surfaces, must be made suitably large. However this gives rise to a requirement for a correspondingly large radially inward deformation of the attachment ring as the cam surface is pushed downwards between the lug sloping portions. The attachment ring is usually made circumferentially continuous and sufficiently stiff so as to provide the required pull-out resistance. The large radially inward deformation together with this stiffness means that the attachment ring can be quite difficult to press down in between the lugs so as to achieve the eventual snap fit engagement. This can lead to inadvertent breakage of tamper-evidencing features on the cap, e.g. by inexperienced operatives where the caps are hand-applied, or by sub-optimally adjusted or maintained application machinery in the case of automatically applied caps. Use of a smaller radial engagement between the respective upwardly and downwardly facing shoulders and/or a more easily deformable attachment ring eases the cap application problem, but simultaneously leads to a less secure interconnection between the applied cap and the container closure or closure plug. There is therefore room for improvement in the design of the cap and/or plug interengagement features.

The present invention accordingly provides a cap for a container closure or closure plug, comprising a cap top and an attachment ring extending axially downward from beneath the bottom surface of the cap top under a central portion of the cap top; the attachment ring being securingly engageable with the container closure or closure plug; the attachment ring comprising a) a cam surface configured to deflect the attachment ring radially inward upon engagement of the attachment ring with the container closure or closure plug and b) an upwardly facing shoulder above the cam surface; characterised in that the upwardly facing shoulder comprises an inner, radially outwardly extending portion and an outer, upwardly extending lip. This upstanding lip is therefore configured for engagement behind a complementary depending lip which may be provided on the downwardly facing shoulder of the container closure or closure plug lugs, so as to constrain inward deformation of the attachment ring upon attempted forced withdrawal from between the lugs. For a given radial extent of engagement between the upwardly facing shoulder on the attachment ring and the downwardly facing shoulders on the lug guide surfaces, the resistance to forced withdrawal of the attachment ring is thereby increased in comparison to the prior art configuration having a plain upwardly facing shoulder on the attachment ring. As a corollary, the radial extent of the engagement between the upwardly facing shoulder on the attachment ring and the downwardly facing shoulders on the lug guide surfaces may be reduced, while still maintaining satisfactory retention of the attachment ring against forced withdrawal from between the lugs. This results in a reduction in the force required to press the attachment ring down between the lugs until the upwardly facing shoulder thereon snap-fits beneath the downwardly facing shoulders of the lug guide surfaces. The cap attachment ring's upwardly facing shoulder and its lip may be configured and positioned for "backwards compatibility" with legacy plugs whose lugs are not equipped with the complementary depending lips (albeit with reduced resistance against forced withdrawal of the attachment ring).

The cap may comprise tamper indicating features, for example similar to the cap disclosed in EP2144821B1. Thus the cap top and the attachment ring may be connected by at least one frangible connection. Attempts to prise off the cap will break the frangible connection to provide a tamper indication, while leaving the attachment ring retained between the lugs.

The cap top and the attachment ring may additionally be connected by at least one permanent connection configured to retain the cap top and the attachment ring in one piece upon breaking of the at least one frangible connection for removal of the cap from the container closure or closure plug. This assists in convenience of recycling the removed cap, and reduces the likelihood of small broken off pieces of the cap polluting the environment or accidentally being dropped into the container to contaminate its contents.

The at least one frangible connection may be located at a top portion of the attachment ring. The cam surface and the upwardly facing shoulder may thus be positioned at or towards a bottom portion of the attachment ring so that they are recessed well within the container closure or closure plug in use, and are therefore inaccessible to prying-off tools or the like.

The at least one permanent connection may interconnect the bottom portion of the attachment ring and a tear strip extending at least partially within the cap top. The permanent connection, tear strip and at least a part of the cap top may form parts of a handle, by which a user may apply a pulling force directly to the bottom portion of the attachment ring, causing it to distort radially inwardly, whereby the upwardly facing shoulder is disengaged from beneath the downwardly facing shoulders of the container closure or closure plug lugs. For example, the handle may continue in the top portion of the attachment ring, e.g. as a portion of the tear strip defined by a pair of parallel frangible grooves extending part-way down the attachment ring. The permanent connection may interconnect the respective portions of the tear strip in the cap top and in the attachment ring. The cap may comprise a skirt which is frangibly attached to the periphery of the cap top, to provide a further tamper-indicating feature, as well as further securing the attachment ring against illegitimate access in use. The permanent connection may also interconnect the cap top and skirt, so that when the frangible connections between the cap top and skirt have been broken, the skirt forms a ring-shaped portion of the handle, which is graspable to apply the required pulling force to the bottom portion of the attachment ring.

The invention correspondingly provides a screw-threaded container closure or closure plug comprising a plurality of lugs engageable by a wrench or other drive tool and each having a radially inwardly facing guide surface comprising a downwardly and radially inwardly sloping portion and a downwardly facing shoulder extending radially outward below the downwardly and radially inwardly sloping portion; characterised in that the downwardly facing shoulder comprises a radially extending, radially outer portion and a radially inner, depending lip. This depending lip is therefore engageable with the upwardly extending lip provided on the cap, to provide the improved snap-fit retention of the cap as described above. The radially outer portion and the depending lip of the downwardly facing shoulder may nevertheless be configured and positioned for "backwards compatibility" with legacy caps whose attachment rings are not equipped with the complementary upwardly extending lips (albeit with reduced resistance against forced withdrawal of the attachment ring).

Upper ends of the respective guide surfaces may form an entrance portion between the lugs, into which the attachment ring is insertable as a sliding fit. This makes engagement between the cap and the container closure or closure plug (in particular coaxial engagement between the attachment ring camming surface and the downwardly and inwardly sloping portions of the lug guide surfaces) easier.

The downwardly facing shoulder may be formed by undercut groove positioned at a distance from the upper end of the lug. For example, the undercut grove may be positioned towards the base of the lug. The base of the lug may join a wall of the container closure or closure plug and the undercut groove may be positioned at or near to this wall. This makes the groove/downwardly facing shoulder less accessible to prying-off tools or the like.

The invention is therefore able to provide, in combination, a cap and a screw-threaded container closure or closure plug, the cap comprising a cap top and an attachment ring extending axially downward from beneath the bottom surface of the cap top under a central portion of the cap top; the attachment ring being securingly engageable with the container closure or closure plug; the attachment ring comprising a) a cam surface configured to deflect the attachment ring radially inward upon engagement of the attachment ring with the container closure or closure plug and b) an upwardly facing shoulder above the cam surface;

the container closure or closure plug comprising a plurality of lugs engageable by a wrench or other drive tool and each having a radially inwardly facing guide surface comprising a downwardly and radially inwardly sloping portion and a downwardly facing shoulder extending radially outward below the downwardly and radially inwardly sloping portion;

characterised in that the upwardly facing shoulder comprises an inner, radially outwardly extending portion and an outer, upwardly extending lip and the downwardly facing shoulder comprises a radially extending, radially outer portion and a radially inner, depending lip complementary to the outer, upwardly extending lip.

For a more complete understanding of the invention and some of its further features and advantages, illustrative and non-limiting embodiments are described below with reference to the drawings in which:

FIG. 1 is a schematic cross-sectional view showing a cap embodying the present invention being offered up for engagement with a closure plug embodying the present invention;

FIG. 2 is a view of portions of the cap and closure plug of FIG. 1 drawn to an enlarged scale and showing those portions interengaged;

Figure 3:
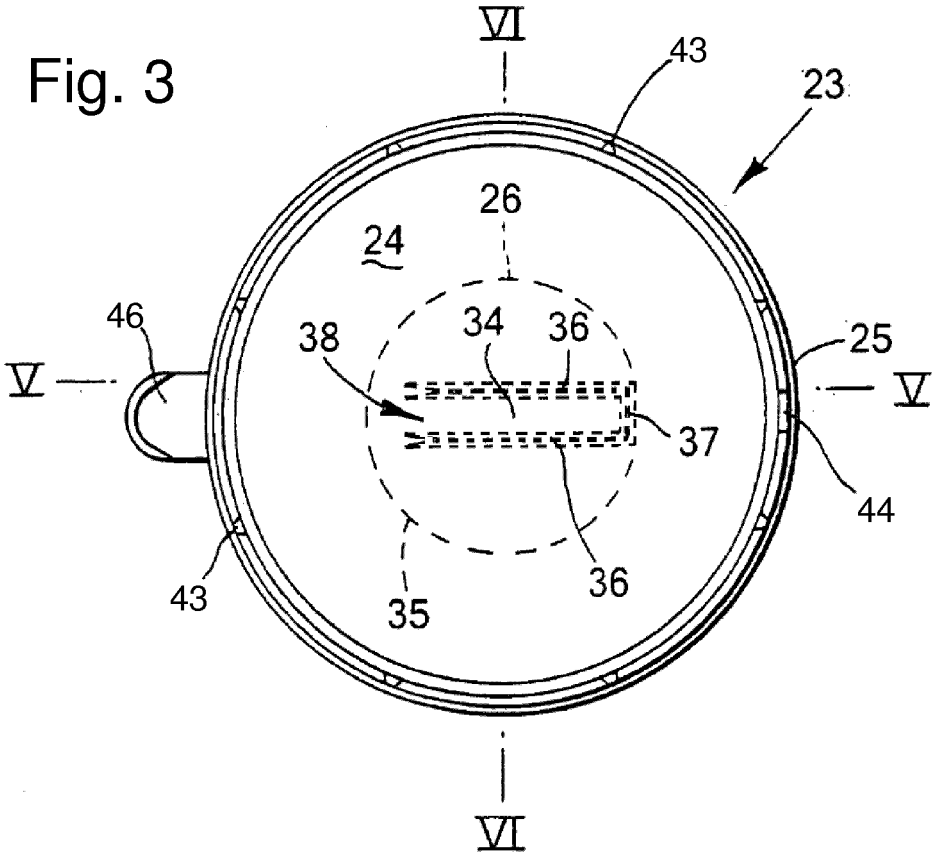
FIG. 3 is a plan of a tamper-evident cap in accordance with the invention.
Figure 4:
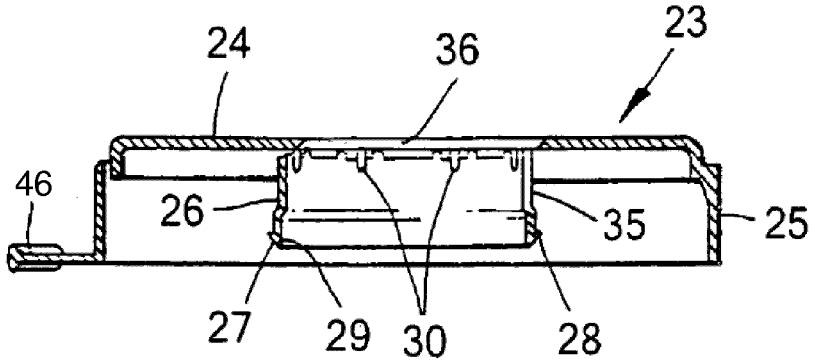
FIG. 4 is a section on the line V-V of FIG. 3.

A tamper-evident cap in accordance with the present invention is illustrated by FIGS. 1 to 8*c* and consists of an imperforate cap 23 moulded of synthetic plastic resin having a disc-like top 24 surrounded by a peripheral depending skirt 25. An attachment ring 26 depends from the central portion of the cap top 24 and terminates at its bottom rim 27 in a radially outwardly projecting flange 28 having an annular, chamfered, downwardly and outwardly facing cam surface 29. The attachment ring 26 is designed as a snap-fit within closure plug 6. On initial fitment of the cap, cam surface 29 meets the radially inwardly facing guide surface 10 of the closure plug lugs 12. At this point, the bottom rim 27 and flange 28 of the attachment ring 28 are received as a sliding fit in a plug entrance portion formed between opposing upper ends 10*a* of the lug guide surfaces 10. As the cap 23 is pressed down on the closure plug 6, the attachment ring 26 is compressed radially inwardly sufficiently for the ring 26 to pass within the downwardly and radially inwardly sloping portion 10*b* of the lug guide surfaces, allowing the ring flange 28 to snap-engage as a tight fit in the locking groove 17. The upwardly facing shoulder 28*a* of the ring 26 formed by the upper surface of the flange 28 engages beneath the downwardly facing shoulder 17*a* formed by the upper wall of the plug groove 17, extending radially outwardly below the downwardly and radially inwardly sloping portion 10*b* of the lug guide surfaces. The downwardly and radially inwardly sloping portions 10*b* transition into the downwardly facing shoulder 17*a*, via a less sharply tapering, near part cylindrical portion 10*c* of the lug guide surfaces 10.

The upwardly facing shoulder 28*a* of the ring 26 has an inner, radially outwardly extending portion 28*b* and an outer, upwardly extending lip 28*c*. Correspondingly, the downwardly facing shoulder 17*a* formed by the upper wall of the plug groove 17 comprises a radially extending, radially outer portion 17*b* and a radially inner, depending lip 17*c*. The upwardly extending or upstanding lip 28*c* is therefore configured for engagement behind the complementary depending lip 17*c*, so as to constrain inward deformation of the attachment ring 26 upon attempted forced withdrawal from between the lugs 12. For this purpose the radially extending, radially outer portion 17*b* of the downwardly facing shoulder 17*a* and its radially inner, depending lip 17*c* need not be confined to precisely the shape or profile shown in the drawings. Similarly, there may be considerable variation in the shape or profile of the inner, radially outwardly extending portion 28*b* and the outer, upwardly extending lip 28*c* of the ring upwardly facing shoulder 28*a*. These components of the ring upwardly facing shoulder on the one hand and the lug downwardly facing shoulder on the other hand, co-operate to form a complementary pair of interlocking hook-like structures, so that the upstanding lip on the attachment ring and the depending lips on the lugs engage behind one another in the radial direction, to resist inward distortion of the attachment ring as its forced withdrawal from between the lugs is attempted. The radial overlap Y between the lugs 12 and the attachment ring 26 required to provide a given pull-out resistance may therefore be reduced. The reduced radial overlap Y reduces the distortion of the ring required to pass the lug guide surface portions 10*b*, and hence the amount of force required to fit the cap 23 to the plug 6. A suitable clearance X, at least equal to the height of the upwardly extending lip 28*c* above shoulder portion 28*b*, is provided between the bottom end of the ring 26 and the lower side of the undercut groove 17. With the skirt 25 grounded on the container or container neck 1, FIG. 8*a*, the resiliency of the cap top 24 may be used to allow the tips of the lips 28*c*, 17*c* to pass one another in the vertical (axial) direction as the cap 23 is pressed into the plug 6; this resiliency then pulling the lip 28*c* up behind the lips 17*c* once the flange 28 has snapped into the grooves 17 and the application pressure has been released. In this way, a firm, play-free fit between the cap and the plug/container can be achieved.

The cap 23 and the attachment ring 26 are formed as a single moulding with the ring axially separated from the cap top 24 by a series of frangible connections 30 and an essentially non-frangible or permanent connection 31. As shown more clearly in FIG. 7 each connection 30 comprises an integrally moulded post 32 upstanding from the attachment ring top rim 33 with the upper end of each post 32 integral with and frangible from the lower surface of cap top 24. In the illustrated embodiment, there is a circular series of eight frangible connections 30 between the cap top 24 and the attachment ring 26, although other numbers and configurations of frangible connection will also be effective.

Figure 5:
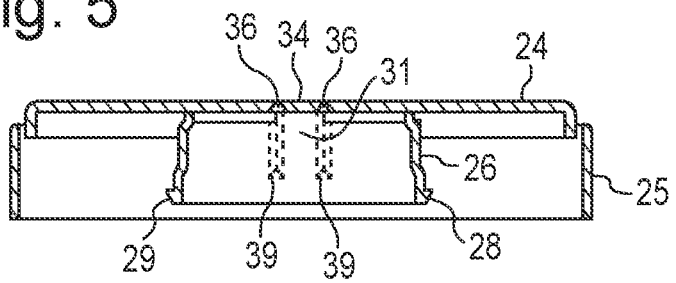
FIG. 5 is a section on the line VI-VI of FIG. 3.
Figure 6:
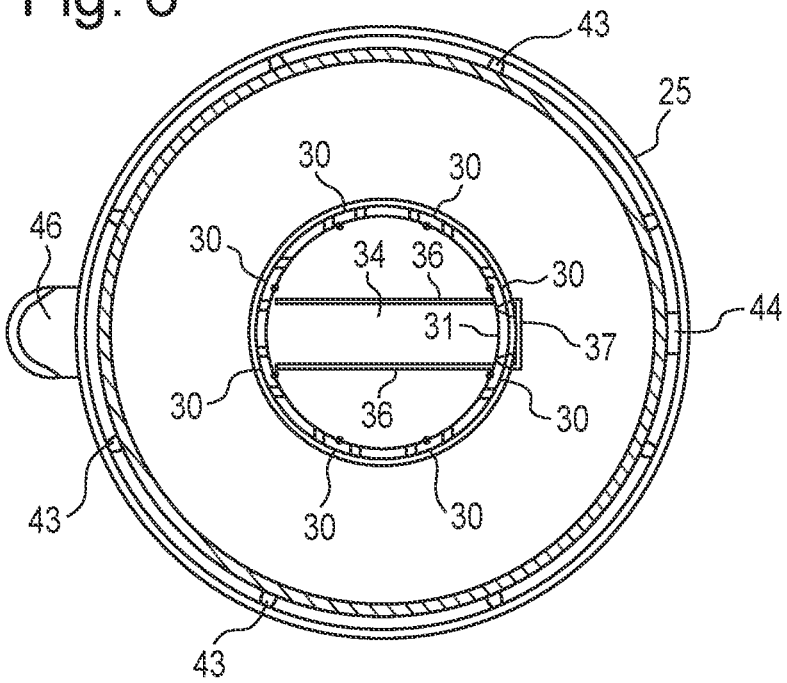
FIG. 6 is a part-sectional underplan view of the cap of FIG. 3.
Figure 7:
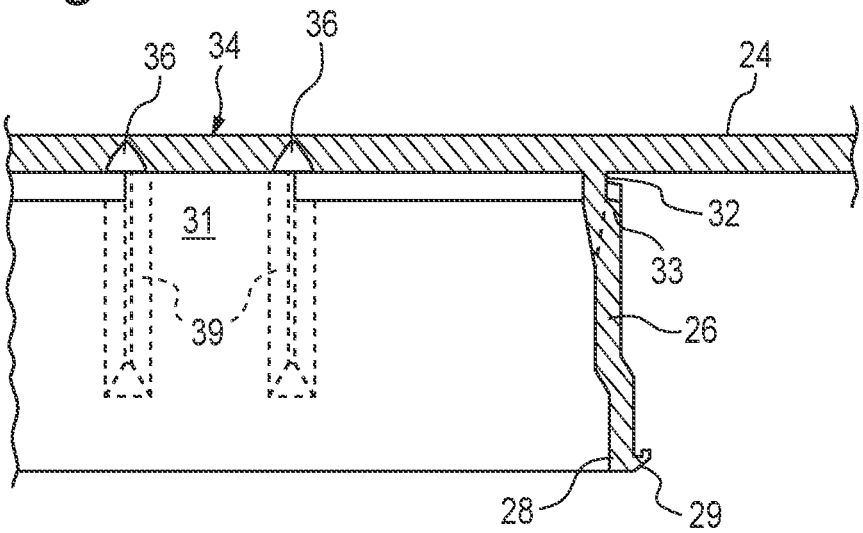
FIG. 7 is an elevational detail illustrating the frangible and tear strip connections between the cap top and the attachment ring of the cap of FIG. 3; and, FIGS. 8*a, b, c* are perspective views showing the removal of the cap of FIG. 3 from a container neck.

A tear-strip 34 extends diametrically of the central region 35 part way across cap top 24, above and within the circle of frangible connections 30, and is formed by a pair of parallel frangible membranous side grooves 36 in the cap top 24 with a further frangible membranous cross groove 37 linking grooves 36 at one end of tear strip 34. As can be seen in FIGS. 5 to 7, the permanent connection 31 links the end of the tear strip adjacent to the cross groove 37 to the attachment ring 26. The frangible grooves 36 continue as a pair of parallel frangible membranous grooves 39 extending from the permanent connection 31 and part-way only down the attachment ring 26; such that this region of the attachment ring 29 forms an integral extension of the tear-strip 34. This integrity is due to the geometry of the cap top tear strip grooves 36, the permanent connection 31 and the attachment ring tear strip grooves 39.

The upper surface of the cap 24 is unbroken and essentially flat, because the membranous grooves 36, 37 and 38 are provided on the bottom (i.e. inner) surface of the cap top 24. This enables the cap 24 to seal a container closure or closure plug, function as a capseal, and to allow for text such as advertising matter, logos, etc. to be applied to or printed on the upper surface of the cap with little or no distortion.

The cap 23 can be fitted to the closure plug 6 simply by pressing the cap down onto the closure plug. This can be achieved manually or by use of a specially shaped tool (not shown). There is no need to rotationally align the cap attachment ring 26 with the closure plug lugs.

Figure 8A:
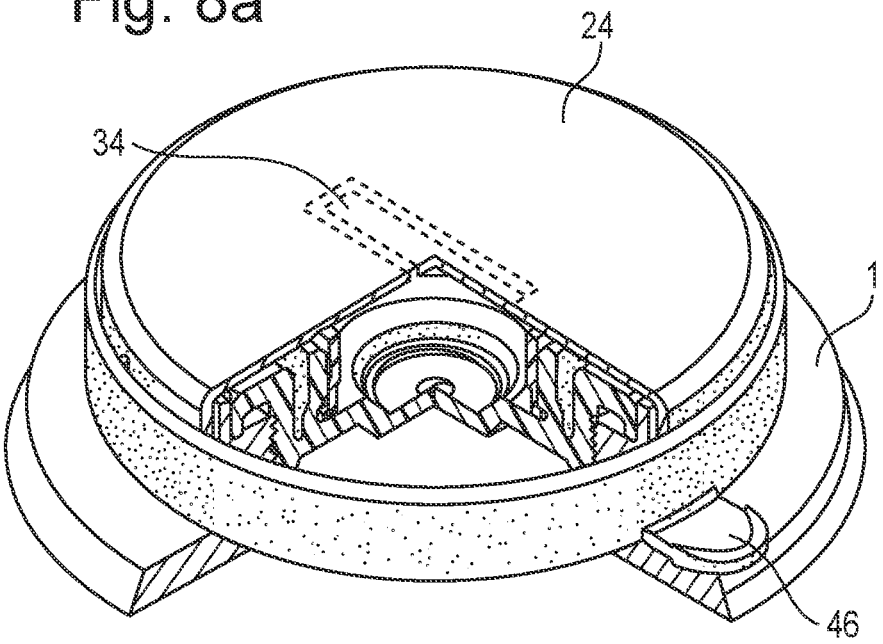
Figure 8B:
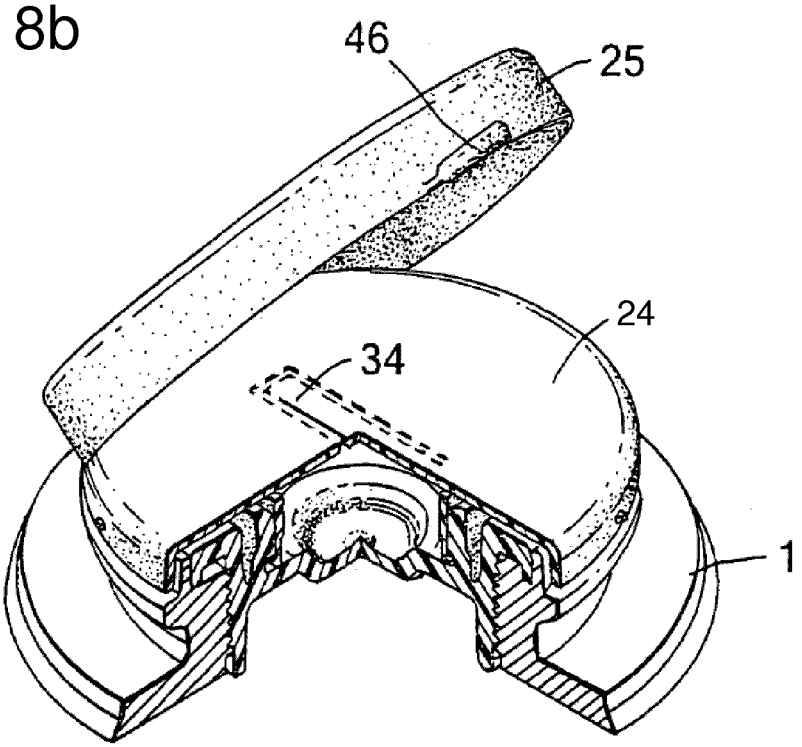
Figure 8C:
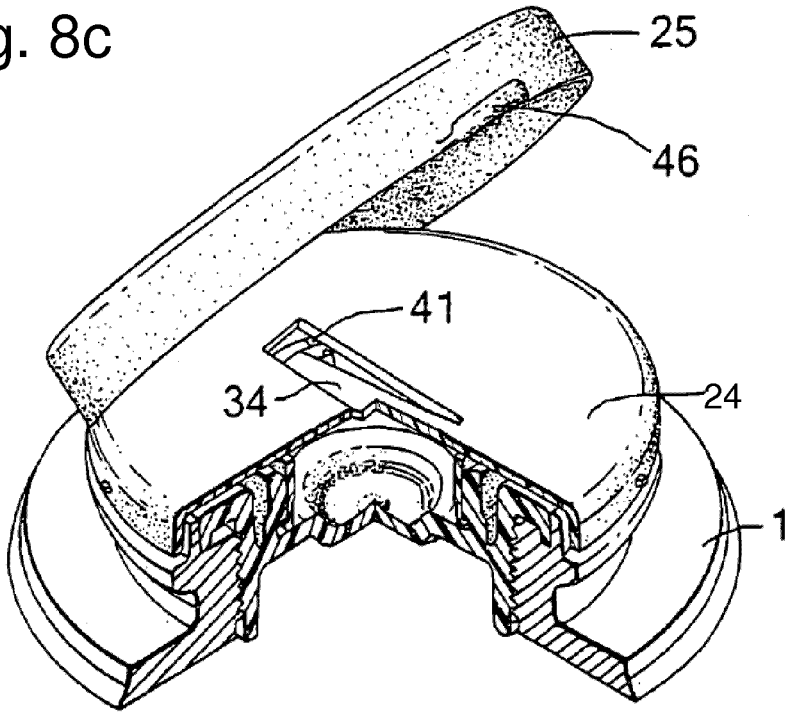

In use and as illustrated by FIGS. 8*a, b, c*, removal or attempted removal of the cap 23 from the closure plug 6 will fracture the connections 30 and frangible grooves 36, 37; the tight-fit snap-fit engagement between the attachment ring 26 and the closure plug 6 being stronger than the tear strength of connections 30 and grooves 36, 37 so that the force required to disengage the attachment ring 26 from the closure cap 6 is greater than that required to fracture connections 30 and grooves 36, 37. As the cap 23 is lifted off the closure plug, the cap top 24 will detach from the attachment ring 26 and the tear strip 34, leaving a visible, tamper-evidencing, rectangular aperture 41 in the cap top centre region 35. The cap top 24 will remain relatively moveably connected to the attachment ring 26 by the tear-strip 34; a top end of tear strip 34 being formed from part of cap top 24 whilst the bottom end of tear strip 34 (delineated by the membranous grooves 39) and permanent connection 31 are formed from part of the attachment ring 26.

Continued removal of the cap top 24 from the closure plug will tear the attachment ring grooves 39, leaving an aperture in the ring wall that permits deflection/distortion of the attachment ring 26, to enable the ring flange 28 to disengage from the closure plug locking groove 17. Cap top 24 and attachment ring 26 will remain connected together by the tear strip 34 after the cap has been removed from the closure plug.

Cap skirt 25 is attached to the cap top 24 by a series of frangible ties 43 (see FIG. 6, in which the skirt 25 and frangible ties 43 are shown un-sectioned) and includes an integral strap 44 between the skirt and the cap top; an integral tab 46 extends radially outwardly from the skirt. In use and as shown by FIGS. 8*a, b* and *c*, the tab 46 is pulled upwardly to fracture the ties 43 so that the skirt 25 forms a ring handle attached by strap 44 to the cap top 24 to assist removal of the cap from the closure plug 6.

The present invention has been illustrated with reference to caps snap-fitted to closure plugs, but it can provide, in accordance with the claims, a permanent connection for any cap having frangible means of attachment to a container closure, wherein a frangible connection can extend between the attachment means and the cap top.

The invention claimed is:

1. A cap for a container closure or closure plug, comprising a cap top and an attachment ring extending axially downward from beneath the bottom surface of the cap top under a central portion of the cap top;

the attachment ring being securingly engageable with the container closure or closure plug; the attachment ring comprising:

a] a cam surface configured to deflect the attachment ring radially inward upon engagement of the attachment ring with the container closure or closure plug, and b] an upwardly facing shoulder above the cam surface; wherein the upwardly facing shoulder comprises an inner, radially outwardly extending portion and an outer, upwardly extending lip.

2. The cap of claim 1, and which further comprises tamper indicating features.

3. The cap of claim 1, wherein the cap top and the attachment ring are connected by at least one frangible connection.

4. The cap of claim 3, wherein the cap top and the attachment ring are additionally connected by at least one permanent connection configured to retain the cap top and the attachment ring in one piece upon breaking of the at least one frangible connection or removal of the cap from the container closure or closure plug.

5. The cap of claim 4, wherein the at least one frangible connection is located at a top portion of the attachment ring.

6. The cap of claim 5, wherein the cam surface and the upwardly facing shoulder are positioned at or towards a bottom portion of the attachment ring.

7. The cap of claim 6, wherein the at least one permanent connection interconnects the bottom portion of the attachment ring and a tear strip extending at least partially within the cap top.

8. The cap of claim 7, wherein the permanent connection, tear strip and at least a part of the cap top form parts of a handle, which enables a user to apply a pulling force directly to the bottom portion of the attachment ring.

9. The cap of claim 8, wherein the handle continues in the top portion of the attachment ring.

10. The cap of claim 9, wherein the handle continues in the top portion of the attachment ring as a portion of the tear strip defined by a pair of parallel frangible grooves extending part-way down the attachment ring.

11. The cap of claim 10, wherein the permanent connection interconnects the respective portions of the tear strip in the cap top and in the attachment ring.

12. The cap of claim 1, comprising a skirt which is frangibly attached to the periphery of the cap top.

13. The cap of claim 12, wherein the cap top and skirt are interconnected in addition by a permanent connection.

14. A screw-threaded container closure or closure plug comprising:

a plurality of lugs engageable by a wrench or other drive tool and each having a radially inwardly facing guide surface comprising a downwardly and radially inwardly sloping portion and a downwardly facing shoulder extending radially outward below the downwardly and radially inwardly sloping portion;

wherein the downwardly facing shoulder comprises a radially extending, radially outer portion and a radially inner, depending lip.

15. The container closure or closure plug of claim 14, wherein upper ends of the respective guide surfaces form an entrance portion between the lugs into which the attachment ring is insertable as a sliding fit.

16. The container closure or closure plug of claim 14, wherein each downwardly facing shoulder is formed by an undercut groove positioned at a distance from the upper end of the respective lug.

17. The container closure or closure plug of claim 16, wherein the undercut groove is positioned towards the base of the lug.

18. The container closure or closure plug of claim 17, wherein the base of the lug joins a wall of the container closure or closure plug and the undercut groove is positioned at or near to this wall.

19. In combination, a cap and a screw-threaded container closure or closure plug, the cap comprising a cap top and an attachment ring extending axially downward from beneath the bottom surface of the cap top under a central portion of the cap top; the attachment ring being securingly engageable with the container closure or closure plug; the attachment ring comprising a] a cam surface configured to deflect the attachment ring radially inward upon engagement of the attachment ring with the container closure or closure plug and b] an upwardly facing shoulder above the cam surface;

the container closure or closure plug comprising a plurality of lugs engageable by a wrench or other drive tool and each having a radially inwardly facing guide surface comprising a downwardly and radially inwardly sloping portion and a downwardly facing shoulder extending radially outward below the downwardly and radially inwardly sloping portion;

wherein the upwardly facing shoulder comprises an inner, radially outwardly extending portion and an outer, upwardly extending lip and the downwardly facing shoulder comprises a radially extending, radially outer portion and a radially inner, depending lip complementary to the outer, upwardly extending lip.

* * * * *